United States Patent [19]

Nakagawa

[11] Patent Number: 4,517,941

[45] Date of Patent: May 21, 1985

[54] AIR INTRODUCTION SYSTEM OF A FUEL INJECTION TYPE ENGINE

[75] Inventor: Norihisa Nakagawa, Susono, Japan

[73] Assignee: Toyota Jidosha Kabushiki Kaisha, Toyota, Japan

[21] Appl. No.: 502,113

[22] Filed: Jun. 8, 1983

[30] Foreign Application Priority Data

Dec. 20, 1982 [JP] Japan ..... 57-191167[U]

[51] Int. Cl.[3] ..... F02M 23/02

[52] U.S. Cl. ..... 123/336; 123/432; 123/531; 123/586

[58] Field of Search ..... 123/308, 432, 585–587, 123/531, 336, 339

[56] References Cited

U.S. PATENT DOCUMENTS 4,243,001 1/1981 Yamada ..... 123/432
4,304,211 12/1981 Tezuka et al. ..... 123/432
4,347,816 9/1982 Saito et al. ..... 123/308
4,369,747 1/1983 Jahoda ..... 123/531

FOREIGN PATENT DOCUMENTS 55-64115 5/1980 Japan ..... 123/432

*Primary Examiner*—William A. Cuchlinski, Jr.
*Attorney, Agent, or Firm*—Cushman, Darby & Cushman

[57] ABSTRACT

An air introduction system of a fuel injection type engine, including a main passage and a fuel injector for injecting fuel into the main passage. Assist air is introduced to the surrounding of a top nozzle portion of the fuel injector so that the assist air acts on the fuel injected from the injector. A subpassage is connected to the main passage so as to supply the assist air. A main valve is disposed in the main passage and a subvalve is disposed in the subpassage. The main and subpassages are formed in a single throttle body.

12 Claims, 2 Drawing Figures

AIR INTRODUCTION SYSTEM OF A FUEL INJECTION TYPE ENGINE

BACKGROUND OF THE INVENTION

1. Field of the Invention

This invention relates to an air introduction system of a fuel injection type internal combustion engine, more particularly, to an air introduction system in which a part of introduced air, hereinafter referred to as "assist air", is supplied to a top nozzle portion of a fuel injector so as to improve the atomization of injected fuel.

2. Description of the Prior Art

In an air assist system of a fuel injection type engine, assist air which does not pass through a throttle valve is introduced to the surrounding area of a top nozzle portion of a fuel injector. Conventionally the flow of the assist air has been controlled in the following manners. In one of the conventionally known air assist systems, the flow of the assist air is set to be constant so that it conforms to a required flow of air in the idling condition of the engine. In this case, however, there is a problem in that the amount of assist air is insufficient at the transitional or usual driving condition of the engine, and the original purpose of the air assist system, that is, promoting the atomization of injected fuel, cannot fully be attained. According to another conventionally known air assist system, the flow of assist air is controlled by an idling speed controller (ISC) or the like, which, however, makes the whole system complicated and expensive, although the original purpose of the air assist system can be satisfactorily attained.

SUMMARY OF THE INVENTION

An object of the present invention is to provide a fuel injection type engine having an air assist system, wherein the flow of assist air can be appropriately controlled in response to the driving condition of the engine in order to fully attain the original purpose of the air assist system.

Another object of the present invention is to provide such an air assist system capable of making the structure of an air introduction system, especially the structure of a throttle body, simple in construction, and easy and less expensive to manufacture.

According to the present invention, there is provided an air introduction system of a fuel injection type engine comprising; a means for defining a main passage for introducing air to be supplied to the engine; a fuel injector for injecting fuel into the main passage; a means for supplying assist air, which is a part of the air to be introduced to the engine, to the surrounding area of the top nozzle portion of the fuel injector so that the assist air acts on the fuel injected from the injector; a means for defining a second or subpassage which is connected to the main passage at an upstream side of the fuel injector, the second or subpassage being connected, at the downstream side, to the assist air supplying means; a main or throttle valve disposed in the main passage between the connecting point and the fuel injector; and a second or subvalve disposed in the second or subpassage.

It is advantageous for at least a part of the main passage and at least a part of the subpassage to be formed in a single throttle body, which also defines therein the point at which the subpassage is connected to the main passage.

In a preferred embodiment of this invention, the subvalve is connected to an acceleration mechanism so that the opening degree of the subvalve in substantially in proportion to an acceleration stroke determined by the acceleration mechanism, and the throttle valve is connected to the subvalve by means of a linking mechanism, so that the throttle valve starts to open when the subvalve is already opened at a predetermined opening degree, and the throttle valve fully opens when the subvalve fully opens.

It is still advantageous for the throttle body to further include a bypass passage which bypasses the subvalve, and an adjusting means for adjusting the air flow in the bypass passage.

DESCRIPTION OF A PREFERRED EMBODIMENT

Figure 1:
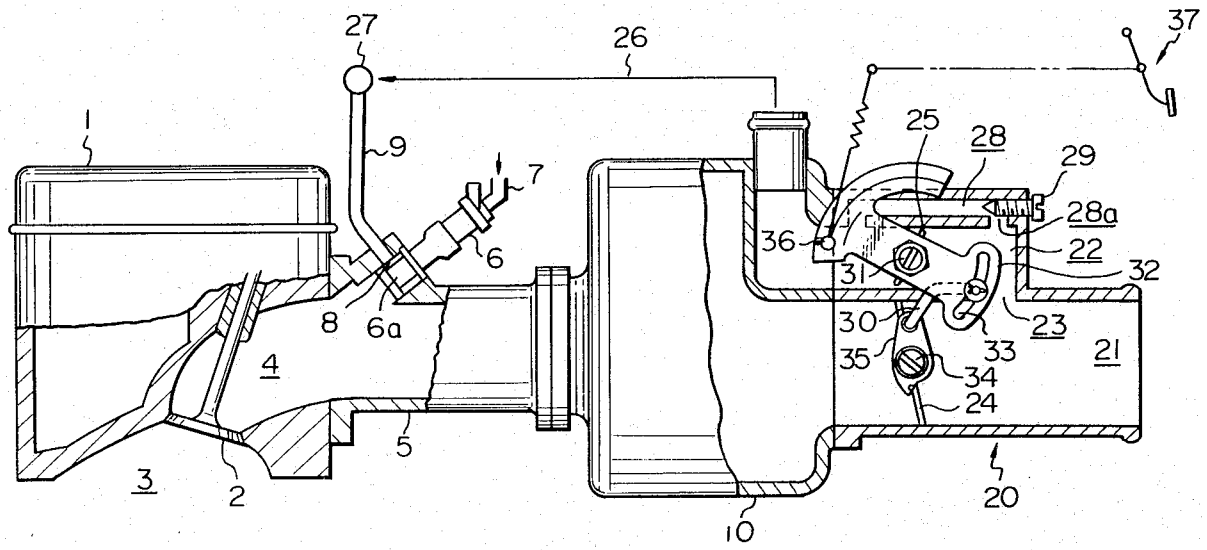
FIG. 1 is a partial cross-sectional view of an air introduction system of a fuel injection type internal combustion engine according to the present invention.

Referring now to FIG. 1, the fuel injection type internal combustion engine of this invention includes a cylinder head 1, air intake valves 2, engine combustion chambers 3 and air intake ports 4. An intake manifold 5 connected to the intake ports 4 is provided for each engine cylinder with a fuel injector 6 which injects the fuel supplied through a fuel passage 7 into the manifold 5 and toward the air intake port 4. Around a top nozzle portion 6*a* of the fuel injector 6 is formed an annular chamber 8, to which an assist air introduction conduit 9 is opened. The assist air introduced through the assist air introduction conduit 9 is discharged from the annular chamber 8 into the intake manifold 5 and the air intake port 4. The assist air acts on the fuel injected form the fuel injector 6 to promote the atomization of fuel and to obtain fine particles of fuel, thereby improving the fuel distribution among multi-cylinders and engine starting, as well as effectively reducing the fuel consumption and notorious emission components.

At the upstream side of the intake manifold 5 there is an air surge tank 10 and at the upstream side of the latter there is a throttle body 20. The throttle body 20 comprises therein a main passage 21 and a subpassage 22 which is branched off from the main passage 21, for introducing the suction air which passes through an air cleaner (not shown in the drawing) and an air flow meter (also, not shown). A main or throttle valve 24 is provided in the main passage 21 at the downstream side of a branched position 23 with the subpassage 22, while a subvalve 25 is provided in the subpassage 22. The subpassage 22 is connected, at the downstream side, to an air delivery pipe 27 via an air line 26, which is connected to the respective air introduction conduits 9. The air delivery pipe 27 serves to distribute and supply the assist air to the air assist introduction conduits 9 each provided for each of the engine cylinders. In the embodiment illustrated in FIG. 1, the subpassage 22 extends over the throttle body 20 and a part of the surge tank 10.

The throttle body 20 also comprises therein a bypass passage 28 which bypasses the subvalve 25 in the subpassage 22, and an idling adjusting means 29, such as an adjusting screw or the like, arranged at an inlet portion 28*a* of said bypass passage 28 for regulating the flow of air flowing from the subpassage 22 into the bypass passage 28. The adjusting member 29 serves to adjust the cross-sectional area of said inlet portion 28*a* so as to supply a prescribed flow of assist air into the bypass passage 28, which flow is required in the idling condition of the engine. On the other hand, the cross-sectional area of the subpassage 22 including the bypass passage 28 is to be determined so that a maximum flow of assist air required for the engine may pass through the subpassage 22 when the subvalve 25 fully opened.

The throttle valve 24 is connected to the subvalve 25 by means of a linking mechanism 30 to cooperate therewith. In order to actuate the subvalve 25, it is ridigly secured to a shaft 31 which is, in turn, attached to a lever 32 which is provided with an extended slot 33. On the other hand, a shaft 34 of the throttle valve 24 is rigidly secured to a lever 35, to the free end of which a linking rod 30 is pivotally connected. The other end of the linking rod 30 is slidably engaged with the extended slot 33 of the lever 32 of the subvalve 25. The lever 32 of the subvalve 25 is connected to an acceleration pedal mechanism 37 by means of a pin 36 fixed on the lever 32.

When the engine is in the idling condition, the subvalve 25 is fully closed and, therefore, the throttle valve 24 is also fully closed. In this situation, all the sucked air is introduced into the bypass passage 28 without passing through both the throttle valve 24 and the subvalve 25, and then flows through the air line 26, the air delivery pipe 27, and the assist air introduction conduits 9 into the intake manifold 5 and the intake ports 4. The flow of the assist air in this situation is, of course, regulated to the amount required in the idling condition of the engine.

When the engine is driving in a light load condition, that is to say, when the stroke of the acceleration pedal 37 is in a small degree, the subvalve 25 opens to a certain degree, but the throttle valve 24 still does not open at all because the extended slot 33 of the lever 32 allows the sliding movement of the link 30 connected to the throttle valve 24. In this situation, all the sucked air is introduced into the subpassage 22 and flows through the air line 26, the air delivery pipe 27, and the assist air introduction conduits 9 into the engine.

When the stroke of the acceleration pedal 37 is strong enough to open the subvalve 25 more than a prescribed degree, the link 30 connected to the throttle valve 24 cooperates with the extended slot 33 of the lever 32 so that the throttle valve 24 starts to open. The throttle valve 24 is, thus, fully opened, when the subvalve 25 is fully opened in the full load driving condition of the engine.

When the throttle valve 24 opens, the majority of the sucked air is introduced through the main passage 21, the surge tank 10, and the intake manifold 5 into the engine, while some flow of the sucked air (assist air) determined on the pressure difference between the up-and-downstream areas of the throttle valve 24 is introduced from the subpassage 22 through the air line 26, the delivery pipe 27, and the air introduction conduits 9 into the engine.

Figure 2:
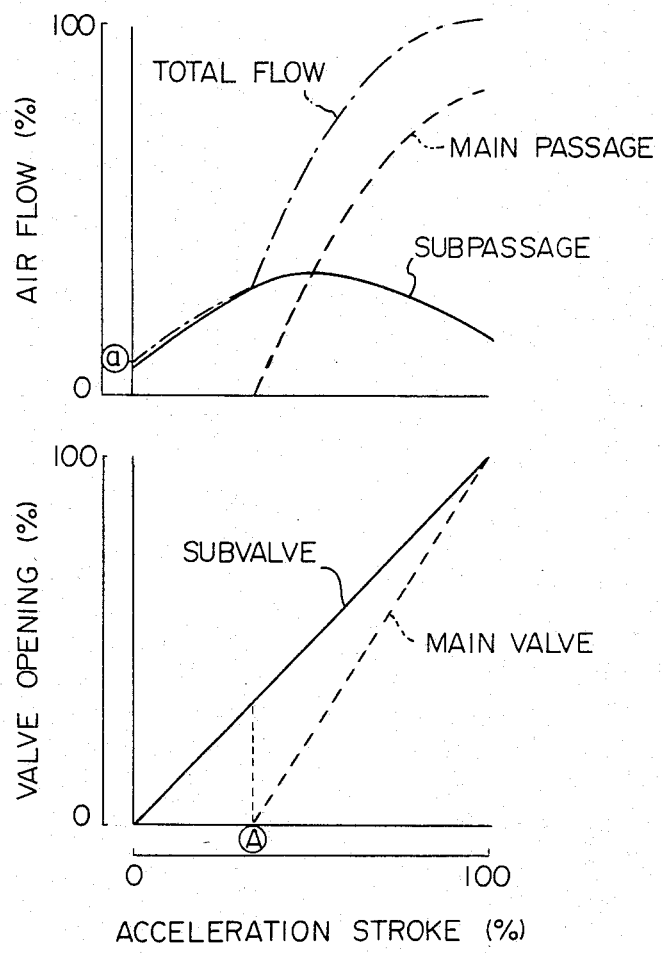
FIG. 2 is a diagram of the relationship between the acceleration stroke, and the valve opening degree and the flow of air in the fuel injection type engine of the present invention.

Referring now to FIG. 2, the relationship between the acceleration stroke (%), and the degree of valve opening (%) and the quantity of air flow (%) is illustrated. The subvalve 25 opens to a degree that is substantially in proportion to the stroke of acceleration. When the acceleration stroke reaches a predetermined degree (A%), i.e., when the subvalve 25 opens to a predetermined degree, the throttle valve 24 starts to open. When the acceleration stroke reaches the maximum, 100%, the subvalve 25 is fully opens, 100%, and the throttle valve 24 also fully opens, 100%. While, the air to be sucked to the engine is introduced only through the bypass passage 28, when the acceleration stroke is zero, i.e., when the engine is running in the idling condition. The air flow in this case is a%. When the acceleration stroke is less than A%, the assist air is introduced through the subpassage 22 so that the flow of air increases as the acceleration stroke increases. When the acceleration stroke is more than A%, the air is also introduced through the main passage 21 as well as the subpassage 22. However, when the opening degree of the throttle valve 24 becomes large, the pressure difference between the up-and-downstream areas of the throttle valve 24 becomes low and the flow of air in the subpassage 22 is reduced. The total flow of air supplied to the engine through both the main passage 21 and the subpassage 22 increases as the acceleration stroke increases. Thus, when the acceleration stroke reaches the maximum, 100%, the flow of air reaches the maximum, 100%.

Accordingly, the air introduction system of the present invention has significant advantages, wherein the flow of assist air which is sufficient under every engine condition can be supplied to the fuel injector, without using an idling speed controller (ISC) or the like, thereby satisfactorily attaining the original purpose of the air assist system, and effectively improving the fuel distribution among multi-cylinders and engine starting, as well as effectively reducing the fuel consumption and notorious emission components. Especially, according to the present invention, all the air is introduced through the subpassage 22 as assist air, until the throttle valve 24 opens, so that sufficient assist air can be obtained even when the engine is in the transitional or usual load driving conditions. The throttle body 20 including the main passage 21 and the subpassage 22 can be integrally formed by, for example, aluminium die casting, which makes it possible to easily manufacture the same at a minimum cost.

I claim:

1. An air introduction system of a fuel injection type engine comprising; a means for defining a main passage for introducing air to be supplied to the engine, said main passage being divided, at the downstream side, into a set of branched passages each connected to one of the engine combustion chambers; a fuel injection provided in each of said branched passages for injecting fuel thereinto; means for supplying assist air, which is a part of said air to be introduced to the engine, to the surrounding area of a top nozzle portion of each of said fuel injectors so that the assist air acts on the fuel injected from said injector; a means for defining a second or subpassage which is connected to said main passage, said second or subpassage being divided, at the downstream side, into a set of assist air introduction conduits each connected to said assist air supplying means; a main or throttle valve disposed in said main passage at the downstream side of said connection point at which said second or subpassage is connected to said main passage; and a second or subvalve disposed in said second or subpassage upstream of said conduits.

2. An air introduction system as set forth in claim 1, wherein at least a part of said main passage and at least a part of said subpassage are formed in a single throttle body, which also defines therein said point at which said subpassage is connected to said main passage.

3. An air introduction system as set forth in claim 2, wherein said throttle body further includes a bypass passage which bypasses said subvalve, and including an adjusting means for adjusting the air flow in said bypass passage.

4. An air introduction system as set forth in claim 1, wherein said throttle valve is connected to said subvalve by means of a linking mechanism so as to cooperate with respect to each other.

5. An air introduction system as set forth in claim 4, wherein said subvalve is connected to an acceleration mechanism so that the opening degree of said subvalve is substantially in proportion to an acceleration stroke determined by said acceleration mechanism.

6. An air introduction system as set forth in claim 5, wherein said throttle valve is connected to said subvalve by means of said linking mechanism, so that said throttle valve starts to open when said subvalve is already opened at a predetermined opening degree, and said throttle valve fully opens when said subvalve is fully opened.

7. An air introduction system of a fuel injection type engine comprising; a means for defining a main passage for introducing air to be supplied to the engine, said main passage being divided, at the downstream side, into a set of branched passages each connected to one of the engine combustion chambers; a fuel injector provided in each of said branched passages for injecting fuel thereinto; a means for defining an annular chamber around a top nozzle portion of each of said fuel injectors, said annular chamber being open to the corresponding branched passage, a means for supplying assist air, which is a part of said air to be introduced to the engine, to said annular chamber so that the assist air acts on the fuel injected from the corresponding injector; a means for defining a second or subpassage which is connected to said main passage, said second or subpassage being divided, at the downstream side, into a set of assist air introduction conduits each connected to said assist air supplying means; a main or throttle valve disposed in said main passage at the downstream side of said connecting point at which said second or subpassage is connected to said main passage; and a second or subvalve disposed in said second or subpassage.

8. An air introduction system as set forth in claim 7, wherein at least a part of said main passage and at least a part of said subpassage are formed in a single throttle body, which also defines therein said connecting point at which said subpassage is connected to said main passage.

9. An air introduction system as set forth in claim 8, wherein said throttle body further includes a bypass passage which bypasses said subvalve, and including an adjusting means for adjusting the air flow in said bypass passage.

10. An air introduction system as set forth in claim 7, wherein said throttle valve is connected to said subvalve by means of a linking mechanism so as to cooperate with respect to each other.

11. An air introduction system as set forth in claim 10, wherein said subvalve is connected to an acceleration mechanism so that the opening degree of said subvalve is substantially in proportion to an acceleration stroke determined by said acceleration mechanism.

12. An air introduction system as set forth in claim 11, wherein said throttle valve is connected to said subvalve by means of said linking mechanism, so that said throttle valve starts to open when said subvalve is already opened at a predetermined opening degree, and said throttle valve fully opens when said subvalve is fully opened.

* * * * *